US005848573A

United States Patent [19]

Hirano et al.

[11] Patent Number: 5,848,573

[45] Date of Patent: Dec. 15, 1998

[54] BUTTON HOLE SEWING MACHINE

[75] Inventors: Yasuaki Hirano, Iwatuki; Kazuaki Ishii, Komae; Mitsuhiro Tachikawa, Hachioji, all of Japan

[73] Assignee: Juki Corporation, Tokyo, Japan

[21] Appl. No.: 685,388

[22] Filed: Jul. 23, 1996

[30] Foreign Application Priority Data

Jul. 27, 1995 [JP] Japan ..... 7-187087
Nov. 20, 1995 [JP] Japan ..... 7-301655

[51] Int. Cl.[6] ..... D05B 3/06; D05B 65/02

[52] U.S. Cl. ..... 112/70; 112/294

[58] Field of Search ..... 112/68, 70, 76, 112/65, 285, 292, 293, 295, 298, 294, 297, 291

[56] References Cited

U.S. PATENT DOCUMENTS 3,847,101 11/1974 Tolle ..... 112/70 X
4,616,582 10/1986 Hager ..... 112/76
4,919,061 4/1990 Riss ..... 112/70

*Primary Examiner*—Peter Nerbun
*Attorney, Agent, or Firm*—Morgan & Finnegan LLP

[57] ABSTRACT

A buttonhole sewing machine includes a holding mechanism attached to a holder arm which reciprocates in a direction perpendicular to an amplitude direction of a needle. The holding mechanism includes a workpiece holder plate and constitutes a parallelogram linkage. The holding mechanism maintains a parallelogram shape even when the holder plate slants on a fold of the workpiece, and securely holds the workpiece. This buttonhole sewing machine also includes a cutting mechanism which cuts thread and braid in a short manner even when the holder plate slants. The cutting mechanism has a rotary cutter and a fixed cutter, and the fixed cutter is fixed on the holder plate while inclined from a proximal portion to a distal portion. A wire member is connected to the mobile cutter to facilitate the rotation of the rotary cutter even when the holder plate slants.

14 Claims, 10 Drawing Sheets

BUTTON HOLE SEWING MACHINE

BACKGROUND OF THE INVENTION

1. Field of the Invention

The present invention relates generally to cyclic seam sewing machines, such as buttonhole sewing machines, and more particularly to a holder device having a cutting mechanism for use with such a cyclic seam sewing machine.

The holder device presses down and holds a workpiece while the sewing machine forms cyclic seams by stitching braid into the seam formed by (sewing) thread. After the desired cyclic seams are formed, the holder device moves, cuts off or severs the thread and braid, and retains one end of the cut thread which is connected to a needle and one end of the cut braid which is connected to a braid spool, a guide member, or any other braid supply source, while releasing the other ends of the cut thread and braid which are both connected the workpiece.

The holder device continues to retain the ends of the thread and braid even after the next sewing is initiated. The thread and braid are then stitched into the new workpiece in the next sewing while the ends of thread and braid are retained by the holder device. This means that the holder device retains the ends of thread and braid which extend from the new workpiece.

When the sewing proceeds to a predetermined point, the holder device is reset, cutting off the thread and braid on its way to the reset position. Thereby, the thread and braid which extend from the new workpiece are cut off in a short manner.

The present invention features such a holder device that has a cutting mechanism which cuts off thread and braid in a short manner even though the holder device slants on a fold, a step or other uneven portions of the workpiece.

2. Description of the Related Art

Several holder devices including a cutting mechanism have been proposed as disclosed in Japanese Patent Publications (Kokoku) Nos. 57-42354 and 59-34387, (both applications being assigned to the same assignee as that of the instant invention). These holder devices have a common structure shown in FIGS. 11–17.

As illustrated, holder device 2 includes holder plate 20 having needle drop opening 16 through which a needle drops into workpiece 11, and U-shaped arm 2*a* which is coupled to the holder plate 20 and rotatable around stepped screw 3*a* relative to holder arm 1. The stepped screw 3*a* extends in a direction perpendicular to a longitudinal direction of the holder arm 1.

The holder device 2 further includes mobile cutter 4 on the holder plate 20. The mobile cutter 4 is rotatable around stepped screw 3*b* which extends in a direction perpendicular to the holder plate 20. As shown in FIG. 11, the mobile cutter 4 possesses approximately V-shaped thread catcher 5 and braid catcher 6 at one side, U-shaped catcher 7 which hooks both thread and braid at the other side, round thread cutter 8, and round braid cutter 9. The thread and braid cutters 8 and 9 are provided at the bottom surface of the mobile cutter 4. As the mobile cutter 4 rotates, the thread cutter 8 follows the same locus as the thread catcher 5 while the braid cutter 9 follows the same locus as the braid catcher 6.

Provided between the mobile cutter 4 and the holder plate 20 is L-shaped fixed cutter 10, which possesses the pair of flat edges 10*a*, 10*b* at the two inner sides of the L shape. The edge 10*a* is engageable with the cutters 8 and 9 to cut thread and braid after sewing is completed, whereas the edge lob is engageable with the catcher 7 to cut both thread and braid after the next sewing is initiated.

The mobile cutter 4 is coupled to fixed pin 13. The fixed pin 13 stands on a rear portion of the mobile cutter 4, and engages with forked arm 14. Referring to FIG. 17, the arm 14 has a pair of slits 14*a* and 14*b*, and is slidable in the longitudinal direction of holder arm 1 through slits 14*a* and 14*b*. One end of L-shaped operational link 47 is coupled to a drive unit such as the one disclosed in Japanese Laid-Open Patent Application No. 54-44962 (which was assigned to the same assignee as that of the instant invention), and is rotatable around shaft 47*a* in the clockwise and counterclockwise directions. The other end of the link 47 is connected to one end of coupling link 48, while the other end of the coupling link 48 is connected to a middle portion of transmission link 49. An upper end of the transmission link 49 is rotatably engaged with the holder arm 1.

Cam plate 50, which is rotatably attached to a frame of the sewing machine, has cam hole 50*a* which is elongated in a direction parallel to the longitudinal direction of the slits 14*a* and 14*b*. Pin 51 perforates the cam hole 50*a* and enables the transmission link 49 to rotate relative to the holder arm 1. The lower end of the transmission link 49 is connected to one end of intermediate link 52, the other end of which is coupled to the forked arm 14.

Thread-retentive plate-spring 44 and braid-retentive plate-spring 45 are fixed by the holder plate 20 above the edge 10*a* of the fixed cutter 10. These plate springs 44 and 45 retain thread and braid to be cut, respectively, in cooperation with an upper surface of the mobile cutter 4 after sewing is completed.

In operation, driven by the drive unit disclosed in Japanese Laid-Open Patent Application No. 54-44962, the holder arm 1 reciprocates right and left in FIG. 11 together with the holder device 2. During this reciprocating motion, the unillustrated needle drops through needle hole "c" and forms cyclic seams on workpiece 11, e.g., darns a buttonhole.

After the sewing is completed, the drive unit rotates the operational link 47 counterclockwise around the shaft 47*a* in FIG. 17, whereby the arm 14 moves in direction A in FIG. 11 through links 48, 49, and 52 and the mobile cutter 4 rotates clockwise around the stepped screw 3*b* through the arm 14 and pin 13. As a consequence, the thread catcher 5 and the braid catcher 6 hook thread and braid, respectively, and go under the plate springs 44 and 45, whereby the thread and braid are retained between the upper surface of the mobile cutter 4 and lower surfaces of the plate springs 44 and 45. As the mobile cutter 4 is rotated further, the thread is cut by the thread cutter 8 and the edge 10*a*, and the braid is cut by the braid cutter 9 and the edge 10*a*, as shown in FIG. 15. In this state, the mobile cutter 4 and plate springs 44 and 45 retain one edge of the cut thread which is connected to the unillustrated needle and one edge of the cut braid which is connected to an unillustrated braid guide member, releasing the other ends of the cut thread and braid which are both connected the workpiece 11.

Even when the next sewing starts, the mobile cutter 4 and the plate springs 44 and 45 continue to retain the ends of the thread and braid. The thread and braid are stitched into the new workpiece as the holder device 2 moves left relative to the (new) workpiece 11 in FIG. 11 in the next sewing. Therefore, the mobile cutter 4 and the plate springs 44 and 45 retain the ends of thread and braid which extend from the (new) workpiece 11.

When the holder device 2 proceeds to the far left of FIG. 11, forming a predetermined number of seams, e.g., twenty seams, the needle becomes sufficiently spaced from the mobile cutter 4. At this position, the mobile cutter 4 no longer collides with the needle even if it rotates. Then, the operational link 47 is rotated clockwise in FIG. 17, whereby the arm 14 moves in direction B and the mobile cutter 4 rotates counterclockwise through the pin 13 as shown in FIG. 11. As the mobile cutter 4 rotates, the catcher 7 hooks both thread and braid, and cuts them in cooperation with the edge 10*b*. Thereby, the thread and braid which extend from the (new) workpiece 11 are also cut off in a short manner by the holder device.

However, such a conventional holder device has several disadvantages:

First, although the holder device 2 is rotatable and inclinable around the stepped screw 3*a* to match fold 11*p* of workpiece 11 as shown in FIG. 13, the arm 14 on the holder arm 1 is merely allowed to reciprocate by the linkage 47–52. Therefore, as the fold 11*p* of the workpiece 11 becomes relatively large and the holder device 2 is inclined steeply, the arm 14 cannot sufficiently move the pin 13 in the direction A shown in FIG. 11, the result being the incomplete rotation of the mobile cutter 4 toward the fixed cutter 10 as shown in FIG. 14 and the failure to cut thread and/or braid.

Second, the rotation of the holder device 2 around the stepped screw 3*a* shifts the position of the holder plate 20 undesirably in the left or right direction in FIG. 13. As a result, brink 16*e* of opening 16 or the mobile cutter 4 may block the needle hole "c". To avoid such situations, it is conceivable to increase the distance between the needle hole "c" and the brink 16*e* and/or the distance between the needle hole "c" and the fixed cutter 10. However, such an arrangement causes longer cutoff leftovers of thread and braid. If thread and braid remain long on a workpiece, the asthetics, quality and economical value of the finished goods are reduced. In addition, manual cutoff of the long leftovers, or so-called thread plucks, if any, are exacting and inefficient enough to increase the number of operational steps. This problem becomes remarkable if the holder device 2 slants in a direction opposite to that of FIG. 13. The distance between the needle hole "c" and the fixed cutter 10 becomes longer, causing longer leftovers of thread and braid and/or a failure to cut the thread and braid.

Third, it is necessary for the cutter 4 and springs 44 and 45 to keep enough large space so as to retain and fix thread and braid properly. This large space increases the distance between the cutting spot, i.e., the edge 10*a*, and the needle hole "c", also causing the longer leftovers of thread and braids on the workpiece 11.

Fourth, thread usually has a smaller diameter than that of braid, and each of the cutters 8 and 9 is formed by a round edge. If these cutters 8 and 9 are formed too close to each other, one of the thread and braid cannot be cut down due to the difference in diameter between thread and braid. Therefore, these cutters 8 and 9 cannot be formed close. As shown in FIG. 15, a pair of segments X1 and X2 which are formed by connecting each of the cutters 8 and 9 and the needle hole "c", cannot be parallel to each other, causing longer remainders of thread and braid. In addition, the longer distance between the cutters 8 and 9 also causes the longer rotational radius and longer remainders of thread and braid.

SUMMARY OF THE INVENTION

Accordingly, it is a general object of the present invention to provide a novel and useful holder device having a cutting mechanism in which the above disadvantages are eliminated.

Another and more specific object of the present invention is to provide a holder device having a cutting mechanism which holds a workpiece in a stable position even when the holder device slants on a fold, a step, or other uneven portions of the workpiece, and cuts the thread and braid short, giving a nice-looking appearance.

A holder device of the present invention includes a parallelogram linkage including two pairs of parallel members and four joints. One of the members works as a holder member which holds a workpiece. Even when the holder member slants on a fold, a step or other uneven portions of the workpiece, the linkage maintains a parallelogram, whereby the holder member holds the workpiece in a stable position. The holder device of the present invention may include rigid wire which stably transmits rotational force from an external drive unit to the cutting mechanism, even when the holder device is inclined by a fold, a step or other uneven portions of, the workpiece.

In addition, the cutting mechanism of the holder device of the present invention may include a rotary cutter with a flat edge, a fixed cutter, and a capture arm. The capture arm leads thread and braid to a cutting position, taking the shortest course along the sewing direction after sewing is completed. The guide arm leads both the thread and braid to a position near a center of the rotation of the rotary cutter. The flat edge of the mobile cutter contributes to eliminate the fourth problem of the prior art. Thread and braid can be cut off in a short manner after sewing is completed and initiated, since these cutoff positions are close to positions where the sewing is completed and initiated. The fixed cutter of the cutting mechanism may be inclined from a proximal portion to a distal portion so as to facilitate short cutoff of thread and braid.

Moreover, the present invention arranges the fixed cutter closer to the opening of the holder plate than the retentive position for thread and braid. Such an arrangement contributes to eliminate the third problem of the prior art since the prior art retains thread and braid closer to the opening of the holder plate than the fixed cutter 10, as shown in FIGS. 14 and 15.

Other objects and further features of the present invention will become readily apparent upon review of the following description of the preferred embodiments and accompanying drawings.

DETAILED DESCRIPTION OF THE PREFERRED EMBODIMENT

Figure 1:
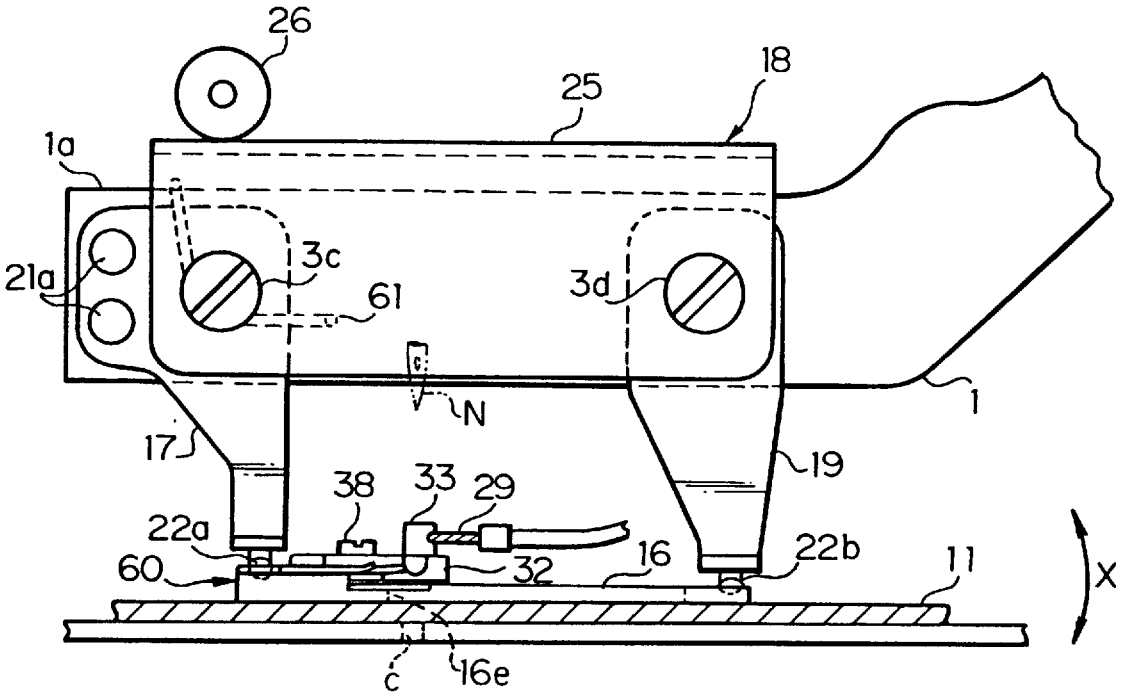
FIG. 1 is a front view of a holder device according to the present invention.

A description will be given of one embodiment of the present invention with reference to FIGS. 1–10. Those elements in FIG. 1–10 which are the same as corresponding elements in FIGS. 11–17 are designated by the same reference numerals, and a description thereof will be omitted.

A buttonhole sewing machine (not shown) includes a drive unit such as the one disclosed in Japanese Laid-Open Patent Application No. 54-44962, where holder arm 1 is supported on the frame of the sewing machine. Driven by the drive unit, the holder arm 1 reciprocates left and right in FIG. 1. The reciprocating direction of the holder arm 1 is perpendicular to the amplitude direction of needle N of the sewing machine. The holder arm 1 possesses approximately rectangular-parallelepiped press supporter la at its free end.

The press supporter 1*a* is connected to a parallelogram linkage including forward link 17, coupling plate 18, backward link 19, and holder plate 60. The holder plate 60 includes needle drop opening 16 through which needle N drops into the workpiece 11 and forms buttonhole seams, stitching braid into them. The linkage is composed of two pairs of parallel members (i.e., 17–19, 60) and four joints.

The forward link 17 is fixed by a pair of screws 21*a* at the top side surface of press supporter 1*a*. One end of the coupling plate 18 is rotatably supported on the forward link 17 through stepped screw 3*c*. The coupling plate 18 includes roller receiving plate 25 above the press supporter 1*a* and is engaged with roller 26 through the plate 25. The roller 26 is rotatably supported on a press mechanism which is attached to the frame of the sewing machine, and applies, via the roller receiving plate 25, pressure to the holder plate 60 transmitted from 20 a spring of the press mechanism, whereby the holder plate 60 holds the workpiece 11 stably.

Figure 5:
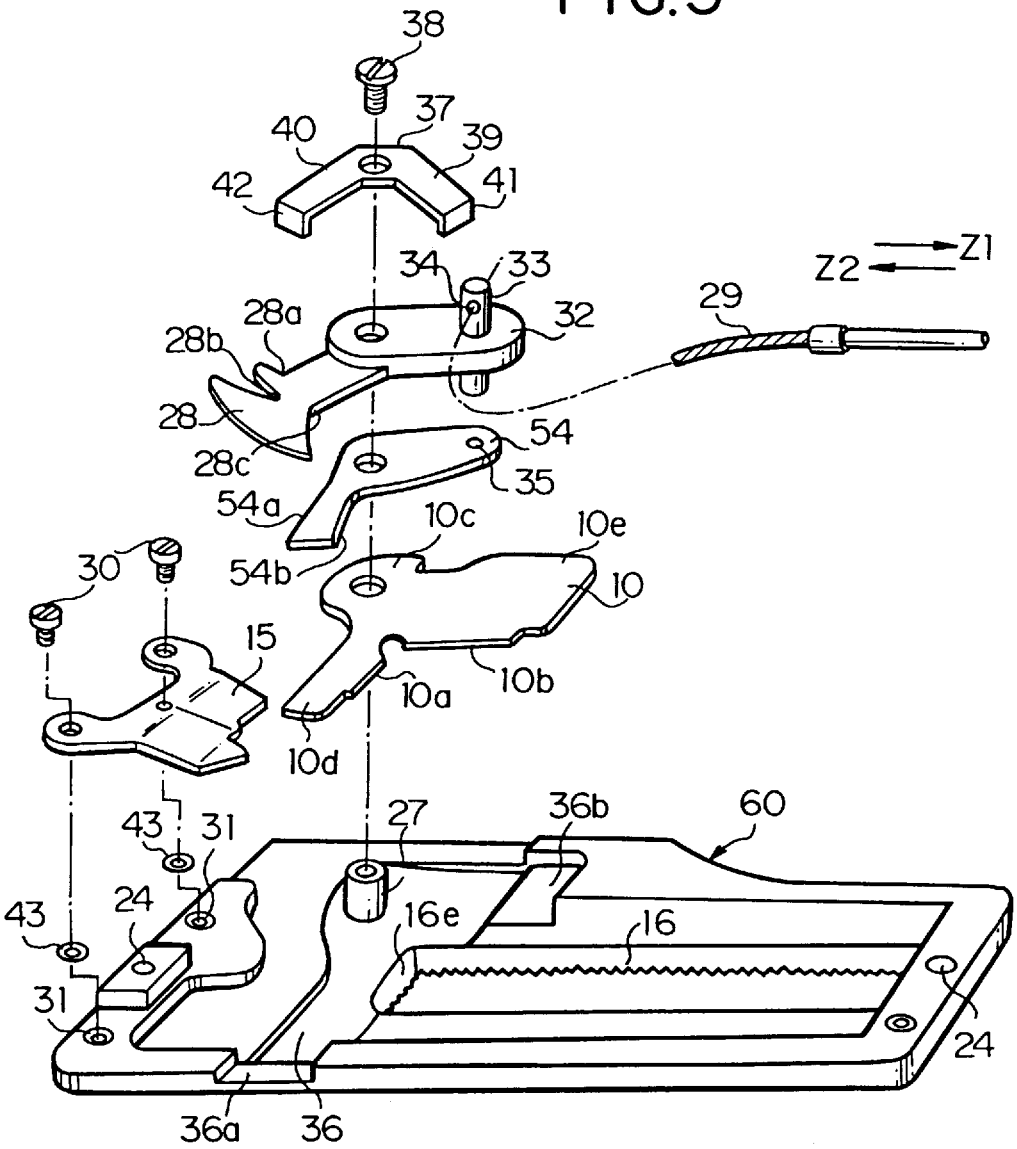
FIG. 5 is an exploded perspective view of a thread and braid cutting mechanism of the holder device shown in FIG. 1.

Stepped screw 3d rotatably supports the other end of the coupling plate 18 and the backward link 19 on the press supporter 1*a*. The forward and backward links 17 and 19 are each bent to form a plate shape at the lower portion, and engaged with sphere pins 22*a* and 22*b*, respectively. As shown in FIG. 5, the holder plate 60 includes a pair of concaves 24 at almost midpoints of its front and back ends or edges to accommodate the sphere pins 22*a* and 22*b* loosely. Needless to say, the position of the sphere pin is not limited to the midpoints of the front and back ends or edges.

Figure 2:
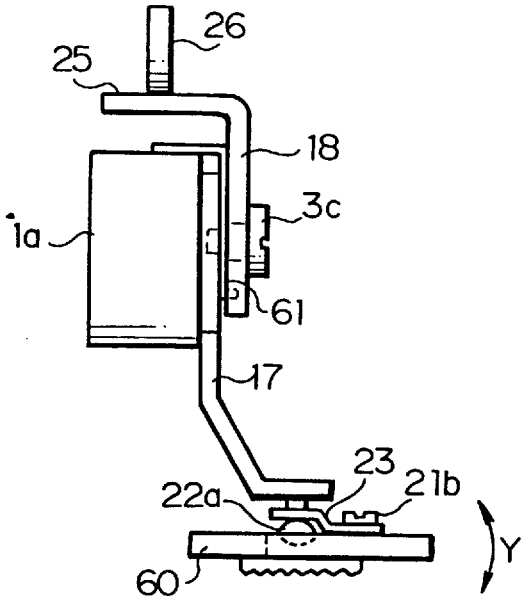
FIG. 2 is a left side view of FIG. 1.
Figure 3:
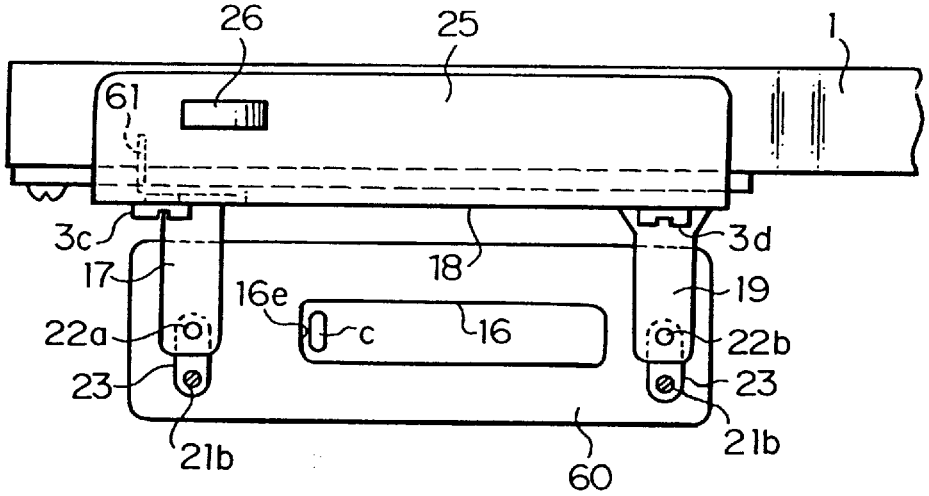
FIG. 3 is a top view of FIG. 1, leaving out a thread cutting mechanism.

Referring to FIGS. 2 and 3, fixed on the holder plate 60 by a pair of screws 21*b* are a pair of plate springs 23 which compress the sphere pins 22*a* and 22*b* into the concaves 24, whereby the holder plate 60 is supported by the bottoms of the links 17 and 19.

The stepped screw 3*c* perforates into coil spring 61, one end of which is fixed onto the holder arm 1 and the other end of which is fixed onto the coupling link 18. Therefore, in a no-load state as shown in FIG. 1, the upper surface of the press supporter la and the roller receiving plate 25 of the coupling plate are parallel to each other, wherein the coupling plate 18 is subject to elastic force to return to the no-load state when rotated around the stepped screw 3*c*.

The parallelogram linkage including the forward link 17, coupling plate 18, backward link 19, and holder plate 60 enables the holder plate 60 to swing around the sphere pins 22*a* and/or 22*b* in the direction X in FIG. 1, and in the direction Y in FIG. 2.

Figure 4:
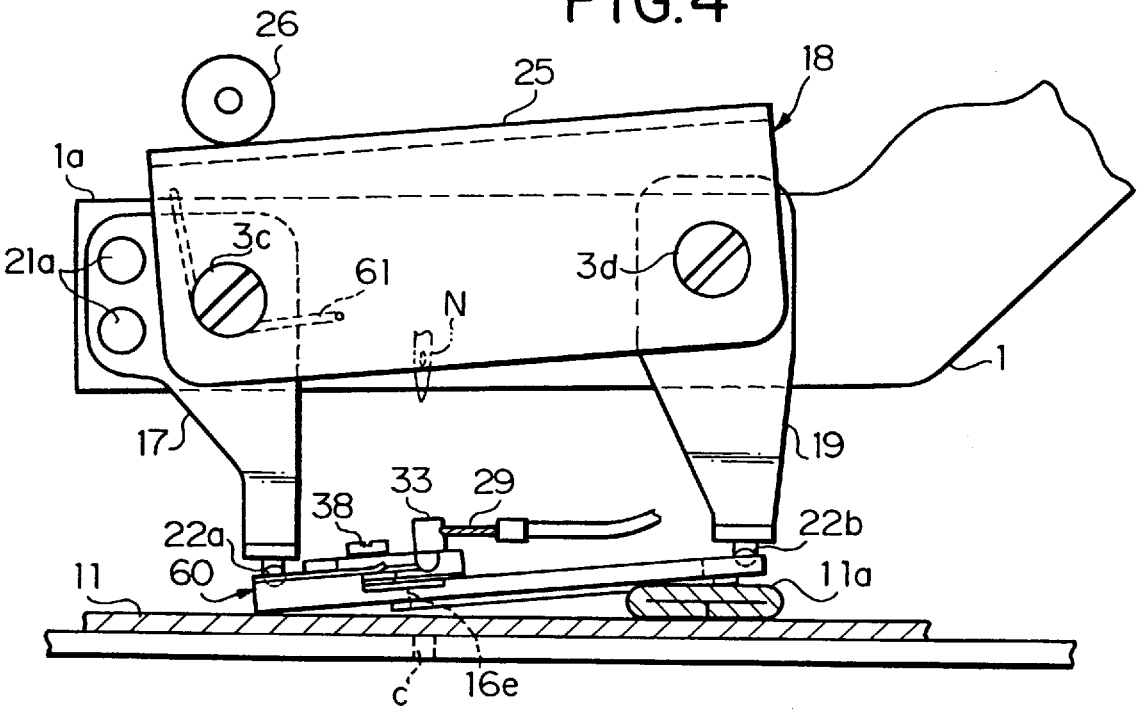
FIG. 4 is a front view of the holder device shown in FIG. 1 in which a holder plate is inclined on a fold of a workpiece.

In operation, referring to FIG. 1, the press mechanism securely holds the workpiece 11 through the roller 26 in a case where the workpiece 11 is even or flat. On the contrary, where the workpiece 11 contains fold 11*a*, the holder plate 60 is inclined as shown in FIG. 4. In this case, the elastic force of the press mechanism moves the roller 26 and shifts it in the left direction in FIG. 4 and rotates the holder plate 60 counterclockwise around the sphere pin 22*a* in FIG. 4. The rotation of the holder plate 60 is transmitted to the coupling plate 18 through the backward link 19. The coupling link 18 rotates counterclockwise around the stepped screws 3*c*, to match slope of the holder plate 60. Thus, the linkage 17–19, 60 maintains a parallelogram.

Thus, the maintained parallelogram shape of the linkage applies the uniform compression force from the roller 26 to the holder plate 60 and enables it to hold the folded workpiece 11 stably, preventing undesired offsetting of the holder plate 60 in the left and/or right direction in FIG. 4. In other words, the holder plate 60 is inclinable around either of the sphere pins 22*a* or 22*b*, and is not rotatable around the stepped screw 3*a* in FIG. 11.

In addition, a longitudinal path of needle N is never blocked by the brink 16*e* in the opening 16 since there is no lateral movement of the holder plate 60 in FIG. 4.

Referring to FIGS. 5–10, a description will be given of a cutting mechanism provided on the holder plate 60 and a structure of the holder plate 60 which facilitates the cutting mechanism.

Figure 7:
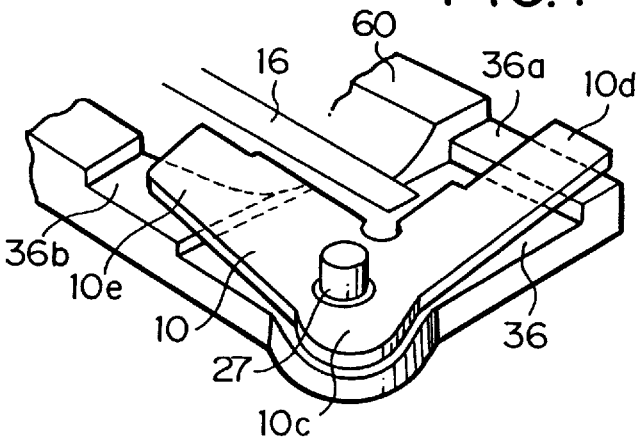
FIG. 7 is a perspective view of a fixed cutter which is set up in position in the thread and braid cutting mechanism of the holder device shown in FIG. 1.
Figure 8:
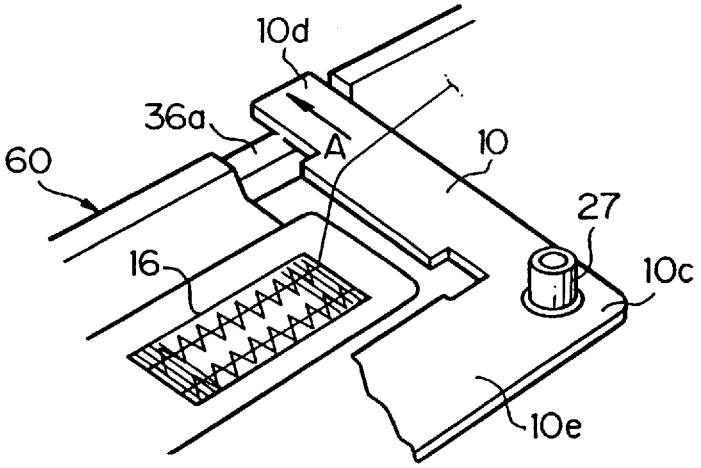
FIG. 8 is a perspective view of a fixed cutter and an opening of the holder device shown in FIG. 1.

Referring to FIG. 5, approximately L-shaped concave 36 is formed on the holder plate 60 near the brink 16*e* to receive the fixed cutter 10. The concave 36 has a pair of elevated steps 36*a* and 36*b* on which a pair of distal portions or ends 10*d* and 10*e* of the fixed cutter 10 are to be placed. Thus, when the fixed cutter 10 is placed on the concave 36, the ends 10*d* and 10*e* are located at higher positions than that of a proximal portion or corner 10*c*, as shown in FIGS. 7 and 8. In other words, the fixed cutter 10 slants in position upwardly from the corner 10*c* to the end 10*d* and from the corner 10*c* to the end 10*e*.

Such a tilt of the fixed cutter 10 prevents undesired offset of thread and braid in the direction A in FIG. 8 when mobile cutter 54 is engaged with the edges 10*a* and 10*b*, promoting short cutoff of thread and braid.

Boss 27 stands on a corner of the concave 36, and pierces into the fixed cutter 10, mobile cutter 54, rotary arm 32 together with capture arm 28, and pressure spring 37, and engages with screw 28.

The boss 27 is loosely inserted into a hole provided at the corner 10*c* of the fixed cutter 10 first, and then loosely inserted into a hole at a corner of the mobile cutter 54. The mobile cutter 54 comprises flat edge 54*a* which cuts thread and braid after sewing is completed, flat edge 54*b* which cuts thread and braid after sewing is initiated, and hole 35. These flat edges 54*a* and 54*b* are provided at opposite sides of one end of the mobile cutter 54, as shown in FIG. 5. Since the mobile cutter 54 according to the present invention uses flat edges 54*a* instead of round cutters 8 and 9, thread and braid are cut off without failure.

The boss 27 is then loosely inserted into a proximal end of rotary arm 32, whereby the rotary arm 32 may rotate around the boss 27. Inserted into a distal end of the rotary arm 32 is through pin 33 having perforation hole 34 at its side in a portion of through pin 33 projecting upwardly from the rotary arm 32, as shown in FIG. 5. The portion of through pin 33 projection downward from the rotary arm 32 is to be inserted into the hole 35 of the mobile cutter 54, thereby rotating the mobile cutter 54 with the rotation of the rotary arm 32. The proximal end of the rotary arm 32 is engaged with a proximal end of the capture arm 28 inclined at a predetermined angle relative to the rotary arm 32.

The capture arm 28 includes, around its distal end, approximately L-shaped thread catcher 28*a* which works after sewing is completed, approximately V-shaped braid catcher 28*b* which works after sewing is completed, and L-shaped catcher 28*c* which works after sewing is initiated.

Figure 6:
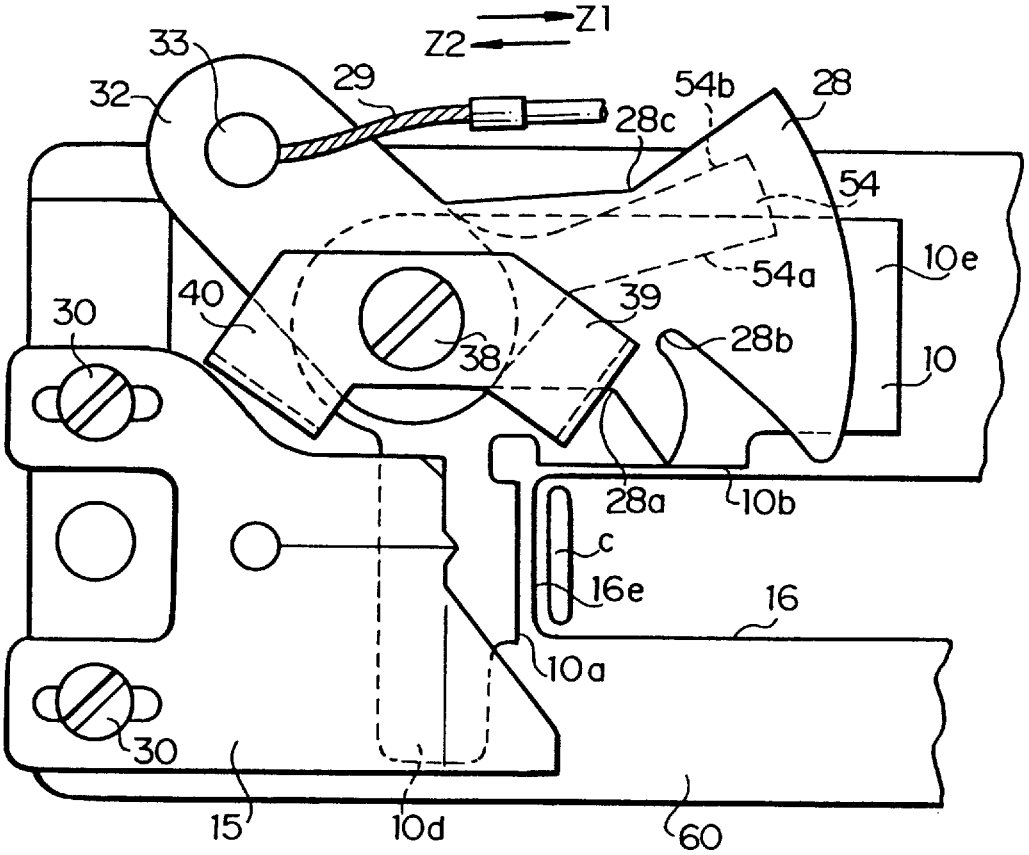
FIG. 6 is a plan view of the thread and braid cutting mechanism of the holder device shown in FIG. 1.
Figure 9:
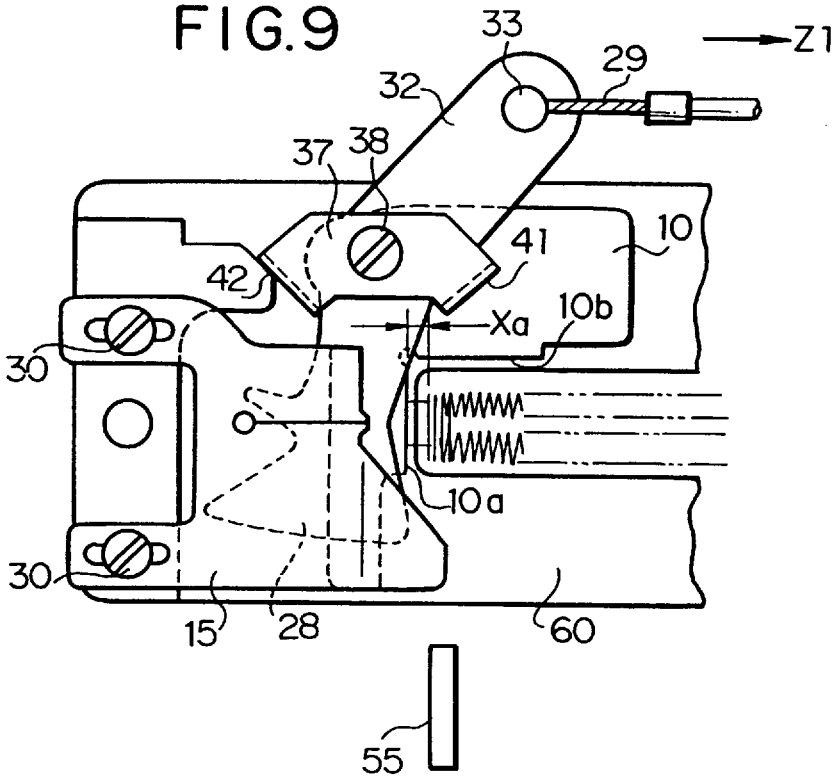
FIG. 9 is a plan view for explaining thread and braid cutting operations after sewing is completed in FIG. 6.
Figure 10:
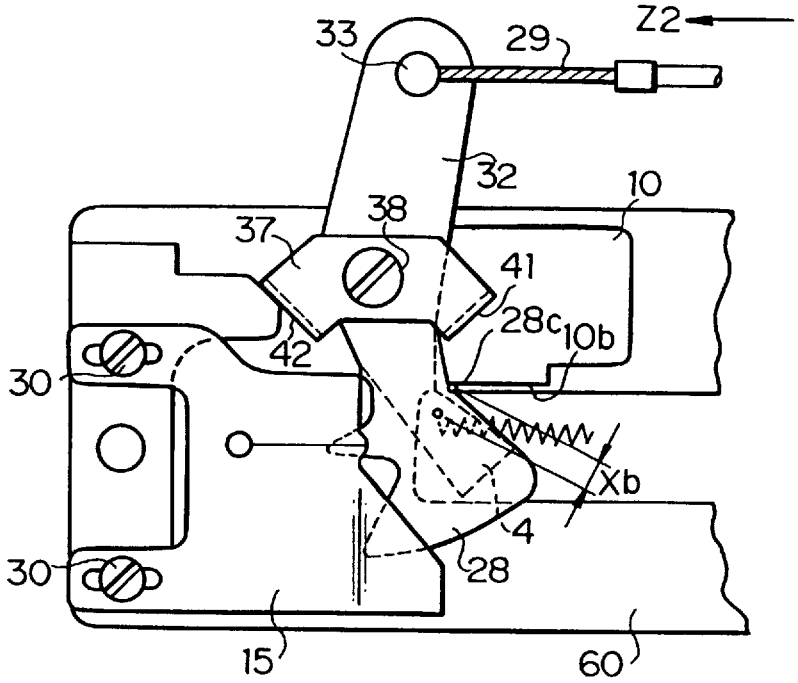
FIG. 10 is a plan view for explaining thread and braid cutting operations after sewing is initiated in FIG. 6.
Figure 11:
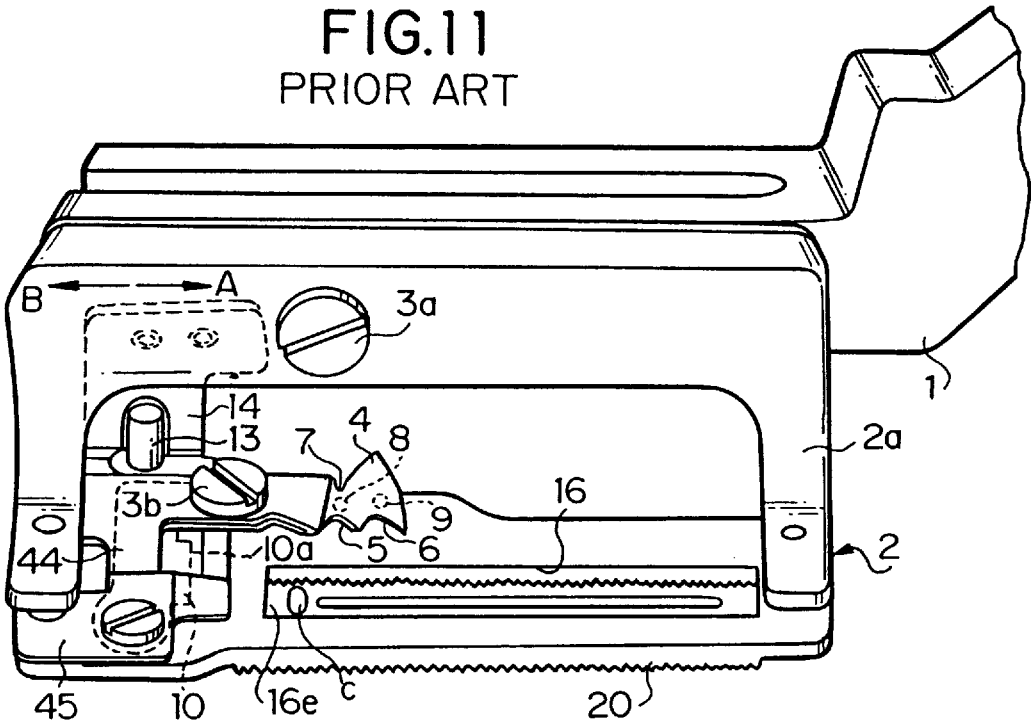
FIG.11 PRIOR ART
FIG. 11 is a perspective view of a conventional holder device.
Figure 12:
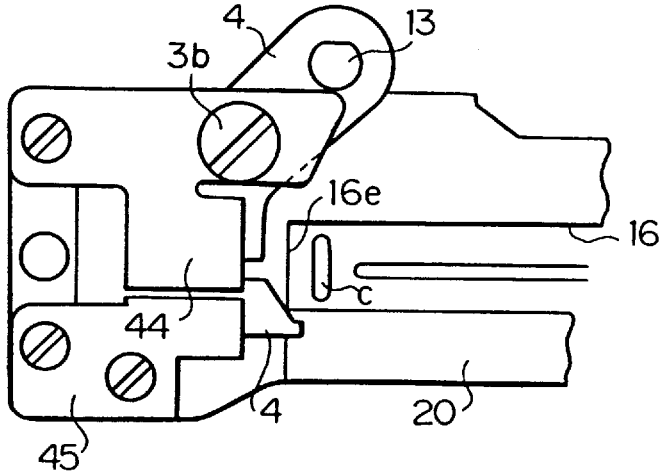
FIG.12 PRIOR ART
FIG. 12 is a plan view for explaining how the conventional holder device shown in FIG. 11 holds an even workpiece.
Figure 13:
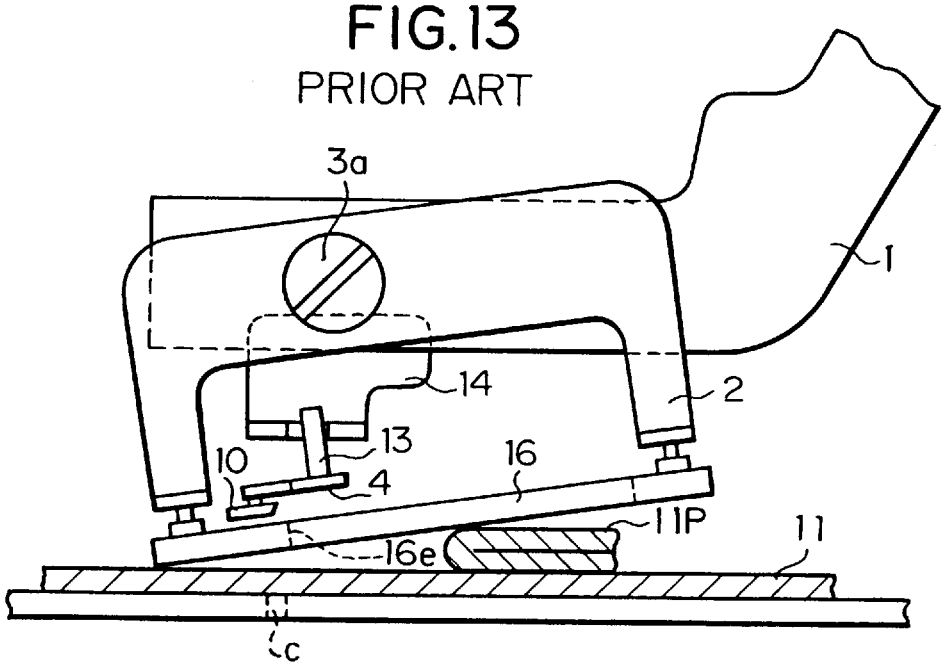
FIG.13 PRIOR ART
FIG. 13 is a side view for explaining how the conventional holder device shown in FIG. 11 holds an uneven workpiece.
Figure 14:
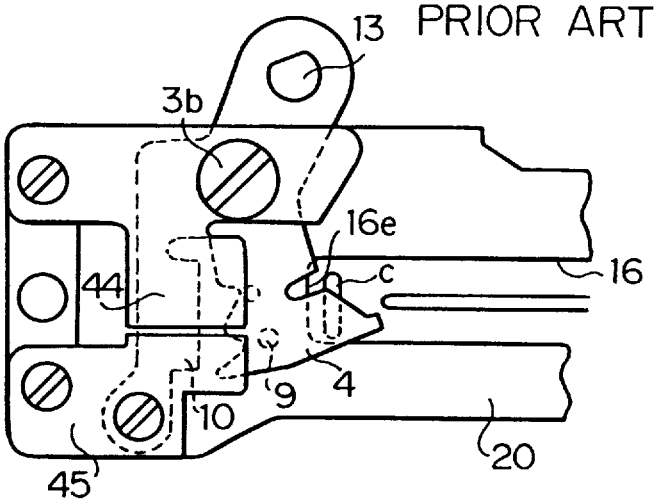
FIG. 14 PRIOR ART
FIG. 14 is a top view for explaining thread and braid cutting operations of the conventional holder device shown in FIG. 11 which is placed on the uneven workpiece.
Figure 15:
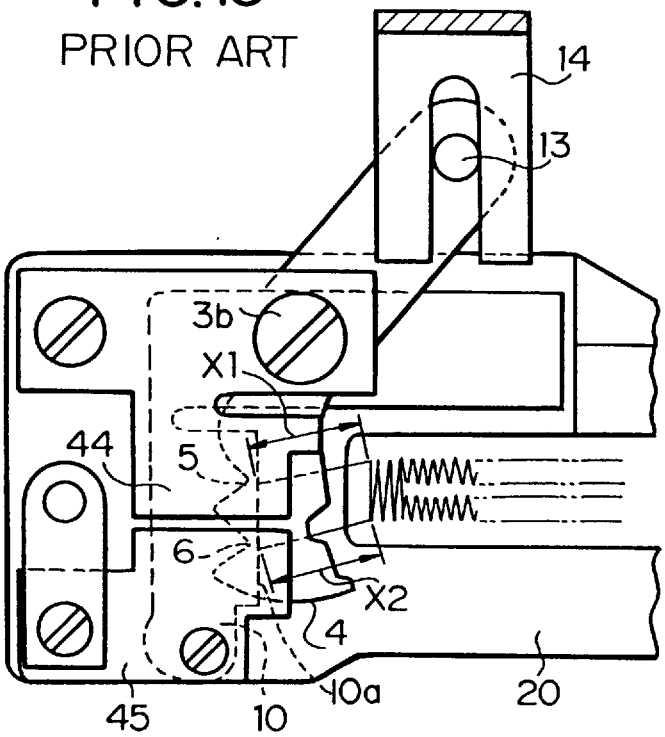
FIG. 15 PRIOR ART
FIG. 15 is a top view for explaining the thread and braid cutting operations of thread and braid in the conventional holder device shown in FIG. 11 after sewing is completed.
Figure 16:
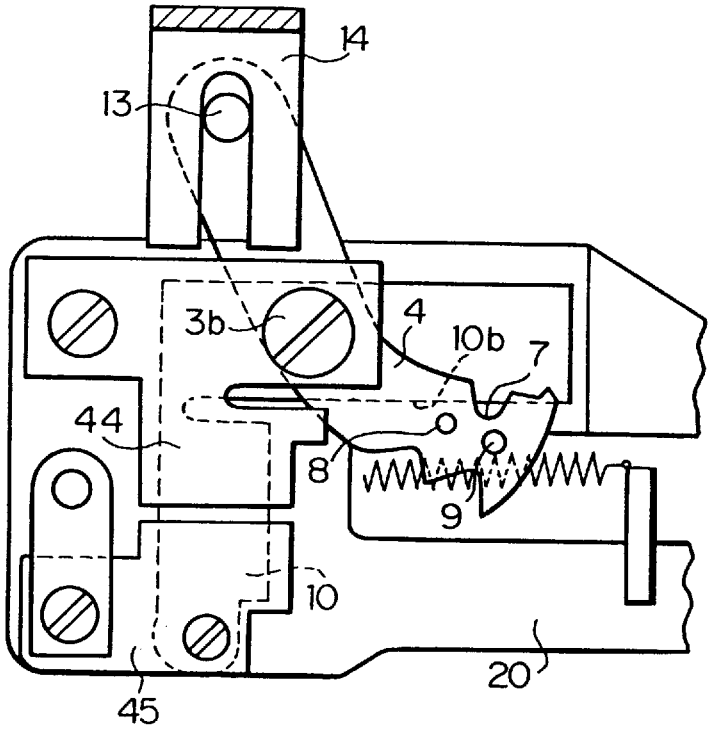
FIG. 16 PRIOR ART
FIG. 16 is a top view for explaining the thread and braid cutting operations in the conventional holder device shown in FIG. 11 after sewing is started.

Referring to FIG. 6, the edge 54*a* of the mobile cutter 54 is located at a position which is retreated counterclockwise from the catchers 28*a* and 28*b*, since it is necessary to secure space for the capture arm 28 to grasp both threads connected to cloth (i.e., workpiece 11) and the needle N, and braid connected to cloth and guide member 55 shown in FIG. 9. The guide member 55 is fully disclosed in, for example, Japanese Patent Publication No. 59-34387. On the contrary, the edge 54*b* is located near the catcher 28*c* since it does not have to retain thread.

Figure 17:
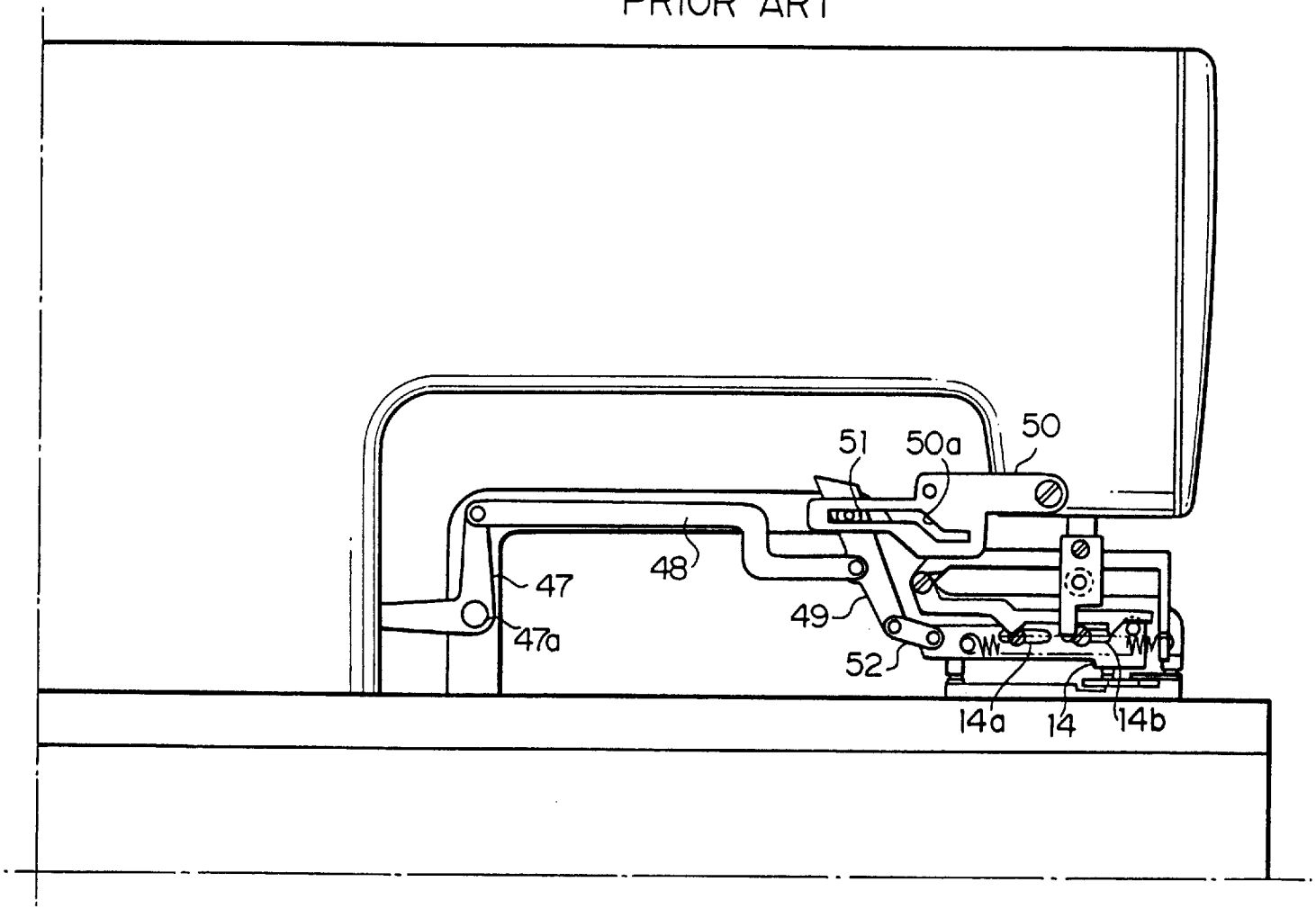
FIG. 17 PRIOR ART
FIG. 17 is a side view of a linkage in the conventional holder device shown in FIG. 11.

Wire 29 is inserted into the perforation hole 34 of the through pin 33; the other end of the wire 29 is fixed, for example, onto a lower portion of the transmission link 49 shown in FIG. 17.

Thus, as the wire 29 moves in the direction Z1 or Z2 in FIG. 1, the mobile cutter 54 and the capture arm 28 rotate around the boss 27 through the rotary arm 32. The wire 29 moves in the direction Z1 and the capture arm 28 rotates clockwise by drawing the wire 29. In addition, the wire 29 resets by its own rigidity against the tensile deformation and moves in the direction Z2, whereby the capture arm 28 rotates counterclockwise.

Needless to say, such a rotating means is not limited to metal wire. Any other wire materials having the desired elastic force and strength, such as, carbon fiber wire and resin wire, are applicable. In addition, instead of using the rigidity of the wire 29, a spring or other members may be provided to reset the wire 29 in the direction Z2.

The L-shaped pressure spring 37 applies enough cutting pressure to the capture arm 28 to cut thread and braid. The cutting pressure is generated from the engagement between the screw 38 and the boss 27.

The pressure spring 37, such as a plate spring, includes press portion 39, rotation restricting portion 40, and a pair of bent portions 41 and 42. The press portion 39*a* applies cutting pressure through the bent portion 41 to the capture arm 28 and the mobile cutter 54, whereby the edge 54*b* successfully slides on the edge 10*b* and cuts the thread and braid, as shown in FIG. 6. The rotation restricting portion 40 provides the bent portion 42 near retentive spring 15 which will be discussed below, and restricts, by the bent portion 42, the clockwise rotation of the capture arm 28 toward the retentive spring 15 in FIG. 9.

As shown in FIG. 5, the retentive spring 15 is provided near the edge 10*a* of the fixed cutter 10. The retentive spring 15, such as a plate spring, is fixed on the holder plate 60 by a pair of washers 43 and a pair of screws 30. The lower surface of the retentive spring 15 holds thread and braid in cooperation with the upper surface of the capture arm 28 after the sewing operation is completed and the capture arm 28 guides the thread and braid to the spring 15 by the catchers 28*a* and 28*b*. Thus, the present invention arranges the fixed cutter 10 closer to the brink 16*e* of the opening 16 than the retentive portion for thread and braid. Since the cutting position is closer to the workpiece 11 than the retentive position, thread and braid can be cut off in a short manner.

A description will be given of operations of a thread and braid cutting mechanism according to the present invention.

Referring to FIG. 6, when a desired sewing operation, such as buttonhole darning, is completed, the compression by the holder plate 60 against the workpiece 11 is released by an unillustrated mechanism. In connection with this release, the wire 29 moves in the direction Z1 and rotates the through pin 33 connected to the wire 29, the rotary arm 32, and the capture arm 28 clockwise around the boss 27. Simultaneous to this rotation, the thread catcher 28*a* and the braid catcher 28*b* of the capture arm 28 hook thread and braid, and the capture arm 28 goes into an aperture between the fixed cutter 10 and the retentive spring 15. Then, the upper surface of the capture arm 28 and the lower surface of the retentive spring 15 hold an edge of the thread at the side of the needle (not shown) and an edge of the braid at the side of the guide member 55 (shown in FIG. 9). Almost simultaneous to this holding, the mobile cutter 54 which rotates with the capture arm 28 receives cutting pressure as a result of the down motion of the retentive spring 15, so that the edge 54*a* slides on the edge 10*a* of the fixed cutter 10 and cuts the thread and braid. During this cutting operation, the slope of the fixed cutter 10 from the corner 10*c* to the end 10*d* prevents the thread and braid from being off the edge 10*a*, and the thread and braid are guided from a position where the sewing is completed to the edge 10*a* of the fixed cutter 10, taking the shortest course. Thus, the finished workpiece 11 has the remainders of thread and braid with length of only Xa shown in FIG. 9.

As the workpiece 11 is moved to a next desired sewing position, the unillustrated mechanism puts down the holder plate 60 and stably compresses the workpiece 11. While the capture arm 28 and the retentive spring 15 hold previously cut leftovers of thread and braid, the sewing machine sews 10–20 seams or up to a position where the capture arm 28 does not collide with the needle N even though the capture arm 28 rotates. Then, the wire 29 moves in the direction Z2 in FIG. 10 by its own rigidity or by force of a spring (not shown). This movement rotates the capture arm 28 and the mobile cutter 54 counterclockwise by the through pin 33 towards their original positions. The thread and braid which have been held by the capture arm 28 and the retentive spring 15 are hooked by the counterclockwise rotation of the capture 28*c* of the capture arm 28, and a slide motion between the edge 54*b* and the edge 10*b* cuts the thread and braid. During the cutting operations, the slope of the fixed cutter 10 from the corner 10*c* to the end 10*e* prevents the thread and braid from going off the edge 10*b*. Therefore, the workpiece 11 at the sewing start position has the remainders of thread and braid with length of only Xb shown in FIG. 10.

Further, the present invention is not limited to the aforementioned preferred embodiments, and various variations and modifications may be made within the scope of the present invention.

What is claimed is:

1. A buttonhole sewing machine comprising:

a holder arm which reciprocates so as to form buttonhole seams;

a holder plate which is connected to said holder arm and moves with said holder arm so as to form the buttonhole seams, said holder plate having a needle drop opening through which the buttonhole seams are formed; and a support mechanism which connects said holder plate to said holder arm so that said holder plate is pivotably inclinable relative to said holder arm, and wherein said support mechanism and said holder plate constitute a parallelogram linkage which includes two pairs of parallel members and four joints, and maintains a parallelogram shape even when the holder plate is inclined.

2. A buttonhole sewing machine comprising:

a holder arm which reciprocates so as to form buttonhole seams;

a holder plate which is connected to said holder arm and moves with said holder arm so as to form the buttonhole seams, said holder plate having a needle drop opening through which the buttonhole seams are formed;

a support mechanism which connects said holder plate to said holder arm so that said holder plate is pivotably inclinable relative to said holder arm; and a cutting mechanism, provided on said holder plate near one end of the needle drop opening, which catches and cuts thread and braid, and wherein said support mechanism and said holder plate constitute a parallelogram linkage which includes two pairs of parallel members and four joints, and maintains a parallelogram shape even when the holder plate is inclined.

3. A buttonhole sewing machine according to claim 2, wherein said cutting mechanism includes:

a rotary member, rotatably supported on said holder plate, which rotates and catches the thread and braid; and a fixed member which is fixed, at a proximal portion thereof, on said holder plate, and has, at a distal portion thereof, a cutting portion which is engageable with said rotary member to cut the thread and braid caught by said rotary member, the cutting portion of said fixed member slanting upwardly from the proximal portion to the distal portion of said fixed member.

4. A buttonhole sewing machine according to claim 3, wherein said holder plate has a concave into which said fixed member is partially inserted and slanted.

5. A holder device for use with a sewing machine, comprising:

a holder plate which holds a workpiece while the sewing machine sews the workpiece; and a support mechanism, hingedly connected to said holder plate, which moves said holder plate and the workpiece relative to a needle of the sewing machine, and slants said holder plate around an edge of said holder plate when said holder plate holds an uneven portion of the workpiece, and wherein said support mechanism and said holder plate constitute a parallelogram linkage.

6. A holder device for use with a sewing machine, comprising:

a holder plate which holds a workpiece while the sewing machine sews the workpiece; and a support mechanism, hingedly connected to said holder plate, which moves said holder plate and the workpiece relative to a needle of the sewing machine, and slants said holder plate around an edge of said holder plate when said holder plate holds an uneven portion of the workpiece, and wherein said support mechanism includes a sphere pin at the edge of said holder plate and said support mechanism slants said holder plate around the sphere pin.

7. A holder device for use with a sewing machine, comprising:

a holder plate which holds a workpiece while the sewing machine sews the workpiece; and a support mechanism, hingedly connected to said holder plate, which moves said holder plate and the workpiece relative to a needle of the sewing machine, and slants said holder plate around an edge of said holder plate when said holder plate holds an uneven portion of the workpiece, and wherein the sewing machine includes a holder arm, connected to said support mechanism, which moves the support mechanism together with said holder plate and the workpiece relative to the needle of the sewing machine, and wherein said edge of said holder plate includes a first edge and a second edge, and wherein said support mechanism includes:

a forward link which is rotatably connected to the first edge of said holder plate and the holder arm of the sewing machine; and a backward link which is rotatably connected to the second edge of said holder plate and the holder arm of the sewing machine.

8. A holder device according to claim 7, wherein the sewing machine further includes a roller through which holding pressure is applied to the workpiece from said support mechanism and said holder plate, and said support mechanism further includes:

a sectionally L-shaped coupling plate having one surface which is rotatably connected to said forward link and said backward link, and having another surface which is engaged with the roller of the sewing machine; and a spring member which applies elastic force to said coupling plate so as to prevent rotation of said coupling plate.

9. A holder device for use with a cyclic seam sewing machine, said holder device comprising:

a holder plate which holds a workpiece while the sewing machine sews the workpiece with thread and braid;

a support mechanism, connected to said holder plate, which moves said holder plate and the workpiece relative to a needle of the sewing machine; and a cutting mechanism which includes:

a fixed cutter fixed on said holder plate;

a mobile cutter, movably provided on said holder plate, which moves towards said fixed cutter to cut the thread and braid by engaging with said fixed cutter; and a wire member which rotates said mobile cutter.

10. A holder device according to claim 9, wherein said wire member comprises metal wire.

11. A holder device according to claim 9, wherein said wire member comprises carbon fiber wire.

12. A holder device according to claim 9, wherein said wire member comprises resin line wire.

13. A holder device for use with a cyclic seam sewing machine, said holder device comprising:

a holder plate which holds a workpiece while the sewing machine sews the workpiece with thread and braid;

a support mechanism, connected to said holder plate, which moves said holder plate and the workpiece relative to a needle of the sewing machine; and a cutting mechanism which includes:

a fixed cutter fixed on said holder plate;

a mobile cutter, supported on said holder plate, which is rotatable and engageable with said fixed cutter to cut the thread and braid;

a capture arm, supported on said holder plate, which is rotatable to catch and lead the thread and braid toward the fixed cutter; and a spring member, fixed on said holder plate above said fixed cutter, which is engageable with said capture arm so as to fix the thread and braid caught and led by said capture arm, wherein said fixed cutter has a proximal portion and a distal portion, said mobile cutter and said capture arm being rotatable above the proximal portion of said fixed cutter, and said fixed cutter slanting upwardly from the proximal portion to the distal portion.

14. A holder device according to claim 13, wherein said support mechanism and said holder plate constitute a parallelogram linkage.

* * * * *

UNITED STATES PATENT AND TRADEMARK OFFICE

CERTIFICATE OF CORRECTION

PATENT NO. : 5,848,573

DATED : December 15, 1998

INVENTOR(S) : Yasuaki Hirano, et al.

It is certified that error appears in the above-identified patent and that said Letters Patent is hereby corrected as shown below:

Column 1, line 67, after the word "edge", change "lob" to – 10b--.

Column 4, line 18, remove a comma ",".

Column 5, line 39, change "1a", regular appearance, to "1a" bold appearance.

Column 5, line 56, remove "20".

Column 6, line 10, change '1a", regular appearance, to "1a" bold appearance.

Column 8, line 52, change "10-20", bold appearance, to "10-20" regular appearance.

Signed and Sealed this

Fourth Day of May, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,848,573

DATED : December 15, 1998

INVENTOR(S) : Yasuaki Hirano, et al.

It is certified that error appears in the above-identified patent and that said Letters Patent is hereby corrected as shown below:

On the title page, Item [30],
In the Foreign Application Priority Data:

Change the date of application 7-187087 from Jul. 27, 1995 to Jul. 24, 1995

Signed and Sealed this

Third Day of August, 1999

*Attest:*

*Attesting Officer*

Q. TODD DICKINSON

*Acting Commissioner of Patents and Trademarks*